US010327601B2

(12) United States Patent
Bengtsson et al.

(10) Patent No.: US 10,327,601 B2
(45) Date of Patent: Jun. 25, 2019

(54) DISPENSER FOR ROLLS

(71) Applicant: SCA Hygiene Products AB, Göteborg (SE)

(72) Inventors: Mattias Bengtsson, Göteborg (SE); Tomas Gandemo, Göteborg (SE); Erik Hjort, Borlänge (SE); Stig Pommer, Borlänge (SE); Marcus Kullman, Borlänge (SE)

(73) Assignee: ESSITY HYGIENE AND HEALTH AKTIEBOLAG, Göteborg (SE)

( * ) Notice: Subject to any disclaimer, the term of this patent is extended or adjusted under 35 U.S.C. 154(b) by 0 days.

(21) Appl. No.: 15/775,112

(22) PCT Filed: Nov. 16, 2015

(86) PCT No.: PCT/EP2015/076670
§ 371 (c)(1),
(2) Date: May 10, 2018

(87) PCT Pub. No.: WO2017/084689
PCT Pub. Date: May 26, 2017

(65) Prior Publication Data

US 2018/0368629 A1 Dec. 27, 2018

(51) Int. Cl.
*A47K 10/32* (2006.01)
*A47K 10/38* (2006.01)

(52) U.S. Cl.
CPC ..... *A47K 10/3836* (2013.01); *A47K 10/32* (2013.01); *A47K 10/38* (2013.01);
(Continued)

(58) Field of Classification Search
CPC .... A47K 10/3836; A47K 10/32; A47K 10/38; A47K 2010/3253; A47K 2010/3206
See application file for complete search history.

(56) References Cited

U.S. PATENT DOCUMENTS 2,457,293 A * 12/1948 Winzer ..... A47K 10/32 118/419
5,265,816 A * 11/1993 Collins ..... A47K 10/3836 242/560

(Continued)

OTHER PUBLICATIONS

Russian Decision to Grant dated Jan. 28, 2019 issued in Russian patent application No. 2018121618 (9 pages) and its English-language translation thereof (8 pages).

*Primary Examiner* — William A. Rivera
(74) *Attorney, Agent, or Firm* — Drinker Biddle & Reath LLP

(57) ABSTRACT

Dispenser includes housing for at least two rolls of tissue paper, access opening in housing, and closure selectively closing a portion of access opening. Closure includes body, first wall movably connected to body at first edge of first wall; and second wall movably connected to body at first edge of second wall. First and second wall are urged toward each other to respectively position second edges of first and second walls opposite to first edges in a blocking position in which sliding of closure into first or second position is blocked until a predetermined amount of paper of second or first roll, respectively, has been dispensed. Closure includes first and second spring urging first and second walls, respectively, toward each other, spring force of first and second springs being configured to automatically return closure into first or second position, respectively, when sliding of the closure into first or second position, respectively, is blocked.

9 Claims, 6 Drawing Sheets

(52) U.S. Cl.
CPC ..... *A47K 2010/3206* (2013.01); *A47K 2010/3253* (2013.01)

(56) References Cited

U.S. PATENT DOCUMENTS

| | | | | |
|---|---|---|---|---|
| 5,954,256 | A * | 9/1999 | Niada | A47K 10/3836 225/34 |
| 6,364,245 | B1 * | 4/2002 | Paal | A47K 10/3836 225/38 |
| 2005/0167543 | A1 * | 8/2005 | Elliott | A47K 10/38 242/596.8 |
| 2006/0038054 | A1 * | 2/2006 | Tramontina | A47K 10/38 242/560 |
| 2007/0290094 | A1 * | 12/2007 | Anderson | A47K 10/3836 242/594 |
| 2009/0072072 | A1 | 3/2009 | Elliott et al. | |
| 2010/0206979 | A1 | 8/2010 | Collins | |
| 2012/0256036 | A1 | 10/2012 | Osborne | |
| 2015/0076277 | A1 * | 3/2015 | Elliott | A47K 10/3836 242/560 |

* cited by examiner

DISPENSER FOR ROLLS

CROSS-REFERENCE TO PRIOR APPLICATION

This application is a § 371 National Stage Application of PCT/EP2015/076670 filed Nov. 16, 2015, which is incorporated herein in its entirety.

TECHNICAL FIELD

The present application relates to dispensers for rolls particularly of tissue paper such as toilet paper, wipers, hand towels, kitchen towels, etc. More particular, the application relates to dispensers for public restrooms and the like configured to accommodate at least two rolls and successively dispense the rolls. Accordingly, one of the two rolls is a spare roll.

BACKGROUND

One such dispenser is disclosed in U.S. Pat. No. 5,265,816. The dispenser has a slidable closure connected to the dispenser housing. The closure serves to alternatively give access to one of the rolls contained in the housing of the dispenser depending on the remaining amount of paper and to protect the spare roll from being damaged and/or soiled. The closure is formed by a body slidably guided in the housing of the dispenser and first and second walls rotatably attached to the body at a first edge of the walls. One spring connects the first and second walls adjacent the first edges of the walls so as to urge the first and second walls toward each other.

SUMMARY

It is desired to provide a dispenser for rolls of tissue paper ensuring reliable dispensing of the accessible roll and reliably protecting the non-accessible roll.

According to an aspect of the disclosure, a dispenser for rolls of tissue paper, particularly toilet paper, kitchen towels, etc. is suggested. More particular, the disclosure suggests a dispenser to be used in public locations such as public restrooms. The dispenser includes a housing for accommodating at least two of said rolls.

In an embodiment, the housing includes at least two axes (support axes) for rotatably supporting the rolls within the housing. Further, in an embodiment, the housing is configured to capsule the rolls and avoid soiling thereof. An access opening is defined in the housing in order to allow dispensing of the rolls.

In an embodiment, the access opening is defined in a bottom of the housing so that a tail of the roll is freely accessible via the access opening so that the paper of the roll may be dispensed and separated from the rest of the roll through the access opening. Because the housing accommodates two of said rolls, only one of said rolls needs to be accessible at a time so that the remaining roll is still protected from being soiled, etc. This roll may also be referred to as a non-accessible or spare roll.

To obtain this, a closure is provided for selectively closing a portion of the access opening and thereby protecting the non-accessible roll. In order to enable access to the non-accessible roll, thus changing the state of the roll from the spare roll to the accessible roll, the closure is slidably held in the housing and movable between a first position and a second position. In the first position, a first portion of the access opening is closed preventing access to a first roll of said rolls, which is then the non-accessible or spare roll. In a second position, a second portion of the access opening is closed thereby preventing access to a second roll of said rolls or at least a compartment previously holding the second roll, which then becomes also a non-accessible roll or a non-accessible compartment containing the remainder of the previously accessible roll (the substantially dispensed roll or the empty core).

The closure includes a body. The body may be the part which is guided within the housing to obtain the movement of the closure. Further, first and second walls are each rotatably connected to the body at a first edge. In addition, the first and second walls are urged toward each other to respectively position second edges of the first and second walls opposite to the first edges in a blocking position. In this blocking position, sliding of the closure into the respective first or second position is blocked until a predetermined amount of paper of the respective roll has been dispensed. This predetermined amount may be limited by the amount of usable paper in coreless rolls such as those described in EP 1 782 722 A1. Because the center of these rolls is stiffened by water spraying including e.g. starch, the paper in the center of these rolls may stick together and may not be used. Rolls having a core made of paperboard may even entirely be dispensed. Thus, the predetermined amount may be determined based on the outer diameter of the core. In the blocking position, the second edges of the first and second walls respectively interfere with the outer circumferential surface of the roll, if not substantially dispensed to the predetermined amount. Thereby, the closure is prevented from being entirely moved to the respective first or second position. In this case, the closure, however, would remain in an intermediate position between the first or second position at which the respective second edge interferes with the outer circumferential surface of the respective roll. Depending on the amount of paper already dispensed, this intermediate position can be different. The more paper has been dispensed, the further the closure may be moved and the larger the portion of the access opening, corresponding to the non-accessible roll which is opened, becomes.

To return the closure into the respective position covering and protecting the non-accessible roll, a first and second spring respectively connected to the first and second wall are suggested. The spring force of these springs is selected to be sufficiently high to automatically return the closure into the originate position (the first position if slid to the second position/the second position if slid to the first position) when the movement of the closure to the respective other position is blocked by interference of the respective second edge with the outer circumferential surface of the respective roll. Thereby, the wall not interfering with the outer circumferential surface of the accessible roll contacts the outer circumferential surface of the non-accessible roll. In that the respective spring induces a momentum about the axis of rotation of the wall, a force is induced to the closure pushing the closure into its originate position closing the portion of the access opening corresponding to the non-accessible roll. Thereby, it can be ensured that the non-accessible roll is securely protected from being soiled and dispensing of the non-accessible roll is prevented until the accessible roll is substantially dispensed to a predetermined amount and the closure can be moved into the respective other position to give access to the non-accessible roll, which then becomes the accessible roll or dispensed roll.

Because the force is introduced into the first and second walls during movement of the closure at a second edge of the first and second walls most distant from the first edge at which the first and second walls are rotatably connected to the body, a relatively large momentum is induced at the axis of rotation. If torsion springs are for example used to urge the first and second walls toward each other at the axis of rotation, i.e. the second edge, torsion springs having a relatively large spring force were required to return the closure into its originating position. The same applies with respect to the use of one spring as in U.S. Pat. No. 5,265,816 connected to the first and second walls adjacent the first edges, respectively. Also in this case, a relatively large spring force is required. Springs having a relatively large spring force have, however, disadvantages. First of all, it becomes more difficult to slide the closure past the non-dispensed roll to give access to the non-dispensed roll. Further, springs having a relatively large spring force are more expensive and a more expensive construction for attaching the springs and for connecting the first and second walls to the body are required.

One possibility to reduce the necessary spring force for returning the closure into its originate position is that the first and second walls each includes a bump adjacent to the second edge. The bump is a protrusion protruding from the wall toward the inner side, that is toward the roll or the body. To put it differently, the bumps protrude toward each other. Thereby the force initiated onto the roll for returning the closure into its originate position can be adjusted to be more parallel to the sliding direction of the closure, thereby reducing the spring force required to move the closure.

Moreover and particularly if a substantially rectangular (this encompasses also rectangular with rounded edges) housing in a front view seen along the axes of rotation of the rolls is used, it may be advisable to form the first and second walls with a concave portion from the first edges toward the second edges and a convex portion adjacent the second edges, respectively. In this context, the concave portion may correspond to the outer circumferential surface of a non-dispensed roll. The convex portion, in turn, serves to close a distance between a distal end of the concave portion and a wall of the housing. The wall of the housing may be a vertical partition between the two rolls or an outer wall, for example extending along a horizontal direction, approaching the outer circumferential surface of the rolls, respectively. Yet and due to the convex portion, the initiation of force onto the non-accessible roll to return the closure into its originate position is less than optimum. In particular, the initiation of the force is in this case very much angled to the sliding direction of the closure, thus requiring an even higher spring force to allow return of the closure into its originate position. In order to avoid this drawback, it is suggested that the inner surfaces of the bumps facing each other are continuous with the concave portions, respectively, or even extend further inward than the inner surfaces of the concave portions. Thereby, the initiation of the force onto the roll can be improved and springs having a lower spring force can be used.

Another additional or alternative approach to reduce the spring forces is the use of tension springs which are connected with a first end to the first wall and the second wall, respectively, between the first and second edges and with a second end to the body. In an embodiment, the first end of the springs is connected closer to the second edge than to the first edge. Because of the connection between the two edges of the walls, the force of the spring is initiated closer to the second edge, thereby inducing a much higher momentum at the axis of rotation of the respective wall than in a case at which the spring is attached close to the first edge. Accordingly, a spring with a lower spring force may be used.

So as to keep the first and second walls in the blocking position and prevent further rotation of the walls toward each other, a stop is provided for each of the walls, respectively limiting the rotational movement of the first and second walls toward each other. According to one aspect, this stop is multifunctional and also serves as a support protrusion supporting (attaching) the second ends of the first and second springs, respectively. In order not to interfere with the roll, the support protrusion can protrude away from the first and second walls in a direction along an axis of rotation of the first and second walls.

In order to improve the initiation of force onto the roll for returning the closure to its originate position, the first and second springs in the blocking direction of the first and second walls may extend along, for example parallel to, the sliding direction of the closure. In this context, along means that the longitudinal extension of the spring extends at most at an angle of 45° to the sliding direction of the closure.

According to another aspect, the closure should, in its position protecting the non-accessible roll, prevent rotation and, therefore, dispensing of the non-accessible roll. In order to prevent rotation, a rib can be provided on the body, the rib having a gradually increasing height along, for example parallel to, the axis of rotation of the first and second walls or to put it differently of the roll or to the roll axis.

In order to obtain a good mechanical strength of the rib without the risk of being broken, the height of the rib gradually increases to a back wall of the closure, particularly the body, where the rib is connected to the body. Thereby, the rib is supported at its highest position by the back wall and breaking can reliably be prevented.

The rib is, according to one aspect, located at a center between the axis of rotation of the first and second walls on the body. Accordingly, it can be ensured that the roll's outer circumferential surface interferes with the rib or engages with the rib during insertion of the roll and thereby reliably preventing rotation of the roll or at least braking the rotation of the roll (at least making rotation of the roll more difficult).

As used herein, the term "comprises," "comprising," and other derivatives from the root term "comprise" are intended to be open-ended terms that specify the presence of any stated features, elements, integers, steps or components, but do not preclude the presence or addition of one or more other features, elements, integers, steps, components or groups thereof. Accordingly, such terms are intended to be synonymous with "has," "have," "having," "includes," "including," and any derivatives of these words.

Further features of the disclosure, which may either be implemented separately or in combination of one or more of the aforesaid features unless the features contradict each other, are disclosed in the following description referring to the accompanying drawings.

DESCRIPTION OF PARTICULAR EMBODIMENTS

Figure 1:
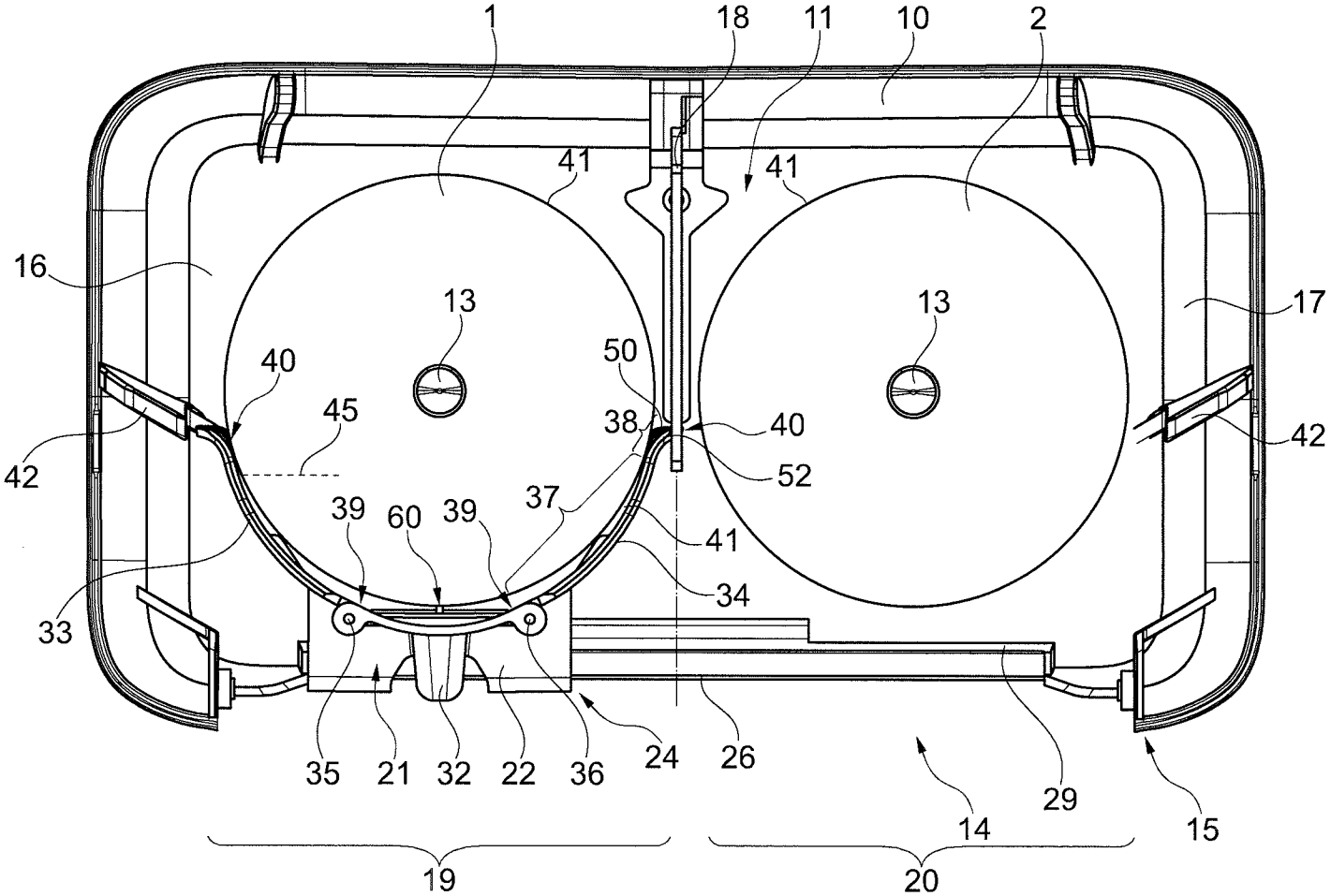
FIG. 1 shows a front view of a dispenser according to an embodiment with a lid being removed.

The dispenser shown in the drawings includes a housing 10 which is shown in the drawings with the lid (not shown) being removed.

In the drawings, the housing 10 is configured for accommodation of two rolls 1, 2. For this purpose, the housing has two axes 13 connected to the housing 10, particularly its back wall 11. In the present embodiment, the dispenser is configured for so-called coreless rolls. Coreless rolls, such as those described in EP 1 782 722 A1, consist of a rolled tissue paper web only. The center of the roll may be subjected to water spraying, wherein the water may contain starch. Thereby, the roll can frictionally be engaged with the axis 13. To enable rotation of the rolls, the axes 13 are rotatably connected to the housing and rotate together with the roll. In an alternative embodiment, it is, however, also conceivable to configure the dispenser for accommodation of two rolls having a core as known from U.S. Pat. No. 5,265,816.

In the drawings, the housing 10 further has an access opening 14 defined in a bottom wall 15 of the housing 10. Moreover, the housing 10 is separated into two compartments 16, 17, one for each roll 1, 2 by a partition 18 in the center of the housing 10. Thereby the access opening 14 is separated into a first portion 19 corresponding to the first roll 1 and a second portion 20 corresponding to the second roll 2.

The dispenser of FIG. 1 further includes a closure 21 slidably supported by the housing 10. The closure 21 includes a body 22.

The body 22 is translationally guided in the housing 10 for sliding of the closure 21 along the guide. For this purpose, a back wall 23 of the body 22 has at its lower end a U-shaped or bend portion 24 being bent away from the body 22 toward the back wall 11 of the housing 10 forming a groove 25 (see FIGS. 2A and 2B). The groove 25 is engaged with a lower end 26 of the back wall 11 of the housing 10 as shown in FIG. 1. Further, the body 22 has on its back wall 23 a rib 27 protruding from the back wall 23 toward the back wall 11 of the housing 10 resting with its lower surface 28 on a protruding surface 29 protruding from the back wall 11 of the housing 10. Finally, an upper end 30 of the back wall 23 engages with a not shown groove formed in a protrusion protruding from the back wall 11 of the housing 10 toward the back wall 23 of the body 22.

The body 22 further includes a handle 32 which may be gripped by a user to slide the closure 21 along the translational guide.

Moreover, the body 22 has two walls, a first wall 33 and a second wall 34. The walls 33, 34 are connected to the body 22 at a first edge 39 being rotatable about a first axis of rotation 35 and a second axis of rotation 36, respectively. Each of the walls 33, 34 is urged by a tension spring 45 about the axis of rotation 35, 36 so that the walls 33, 34 are urged toward each other.

Each of the walls 33, 34 have a concave portion 37 extending from the first edge 39 to a second edge 40 opposite to the first edge 39. The concave portion 37 is concave toward the inside of the compartments 16, 17, respectively, that is toward the rolls 1, 2 accommodated in the housing 10 of the support axis 13. Further, each of the walls 33, 34 has a convex portion adjacent the second edge 40 so that each wall 33, 34 is flared at the second edge 40. This enables that the second edge 40 extends away from the outer circumference 41 of the rolls 1, 2, thereby closing the compartments 16, 17 (in cooperation with the partition 18 and the substantially horizontal walls 42 at the respective side ends of the housing 10 of the dispenser). Thus, the closure 21 with the body 22 and the walls 33, 34 closes one of the compartments 16, 17 depending on its position, so as to prevent access to the respective rolls 1, 2 via the access opening 14, thereby avoiding soiling of the protected non-accessible roll and also preventing dispensing paper from this roll.

Each of the walls 33, 34 has a support protrusion 43 disposed at a respective end of the walls 33, 34 as seen in a direction along the axis of rotation 35, 36. The support protrusion also serves as a stop interfering with the ends of the back wall 23 of the body 22 as shown in FIG. 2B thereby limiting the rotational movement of the walls 33, 34 around the rotational axis 35, 36 toward each other. Additionally, the support protrusions 43 serve as supports or holding structures for attaching second ends 44 of tension springs 45. For this purpose, the support protrusions 43 have a hole into which the second ends 44 of the tension springs 45 are hooked in, respectively.

The first end 46 of the tension springs 44 are connected to the back wall 23 of the body 22. For this purpose, a protruding rib 47 is provided having two holes into which the respective first ends 46 of the tension springs 45 are hooked in. The tension springs 45 urge the walls 33, 34 toward each other about the respective rotational axes 35, 36. As previously mentioned, this rotational movement is limited by the support protrusions 43 interfering with the back wall 23 of the body 22 serving as a stop. Thereby, the walls 33, 34 are positioned in the blocking position shown in FIGS. 1 and 2 by the springs 45.

Bumps 50, which are protrusions extending only over a part of the length of the walls 33, 34 along the rotational axis 35, 36 and protruding toward the rolls 1, 2 or the axis 13 or to put it differently toward each other, are provided adjacent or at the second edges 40. According to one embodiment, an inner surface 51 of the concave portion 37 is continuous with an inner surface 52 of the bumps 50.

Figure 2A:
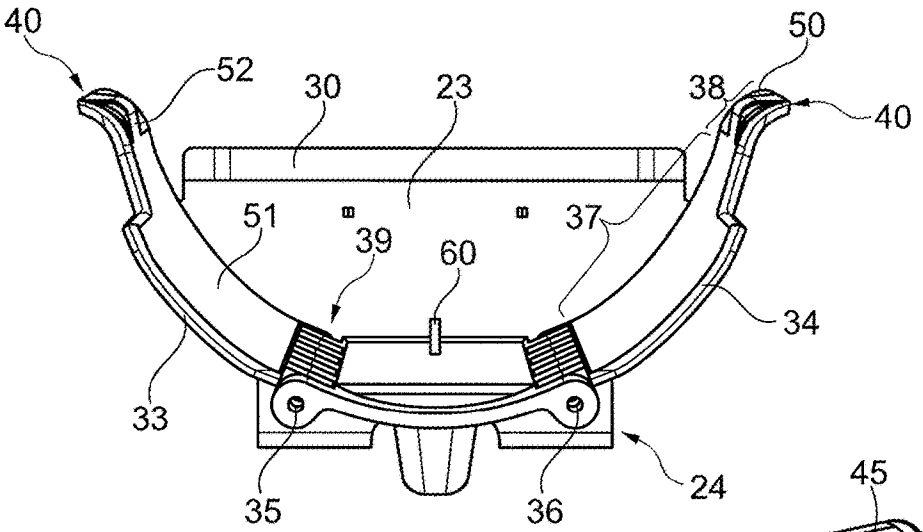
FIG. 2A shows a perspective front view of the closure in FIG. 1.
Figure 2B:
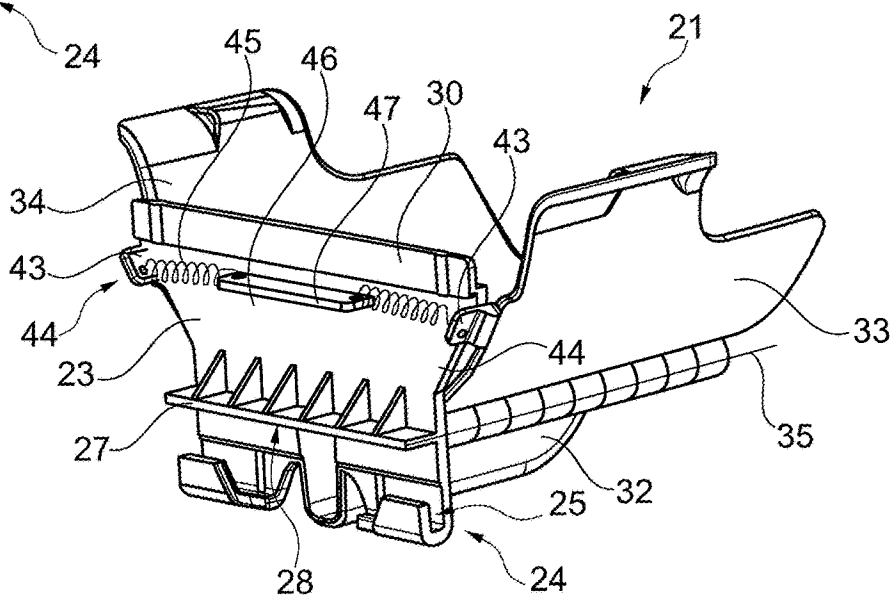
FIG. 2B shows a perspective back view of the closure in FIG. 1.

Moreover, a rib 60 is formed on the body 22 in the center between the rotational axes 35 and 36 as shown in FIG. 2A. The rib 60 has a gradually increasing height and an axial direction of the rotational axes 35, 36 and/or of the support axis 13 and connects at its maximum height to the back wall 23 of the body 22. As shown in FIG. 1, the rib engages with an outer circumferential surface 41 of the non-accessible roll 1, thereby preventing rotation of the roll 1. The rib extends parallel or along the rotational axis 35, 36 and/or along the support axis 13.

In the following, the function of the dispenser described above is explained mainly referring to FIGS. 1 and 3 to 6.

FIG. 1 shows the dispenser loaded with two new, that is non-dispensed, rolls and with the closure 21 in the first position. In the first position, the portion 19 of the access opening 14 is closed by the closure 21. In this position, the body 22 and the first and second wall 33, 34 protect the first roll 1 from being accessed. In particular, the first roll 1 is capsuled in the first compartment 16 which is closed by the closure 21 with the second edges 40 of the first and second walls 33, 34 cooperating with the partition 18 and the wall 42 to close the compartment 16 at a lower end. Further, the first roll 1 is prevented from rotating by the rib 60, because the rib 60 is engaged with the outer circumferential surface 41 of the first roll 1. In this stage the second roll 2 may be accessed by a user via the portion 20 of the access opening 14 to dispense tissue paper from second roll 2.

Figure 3:
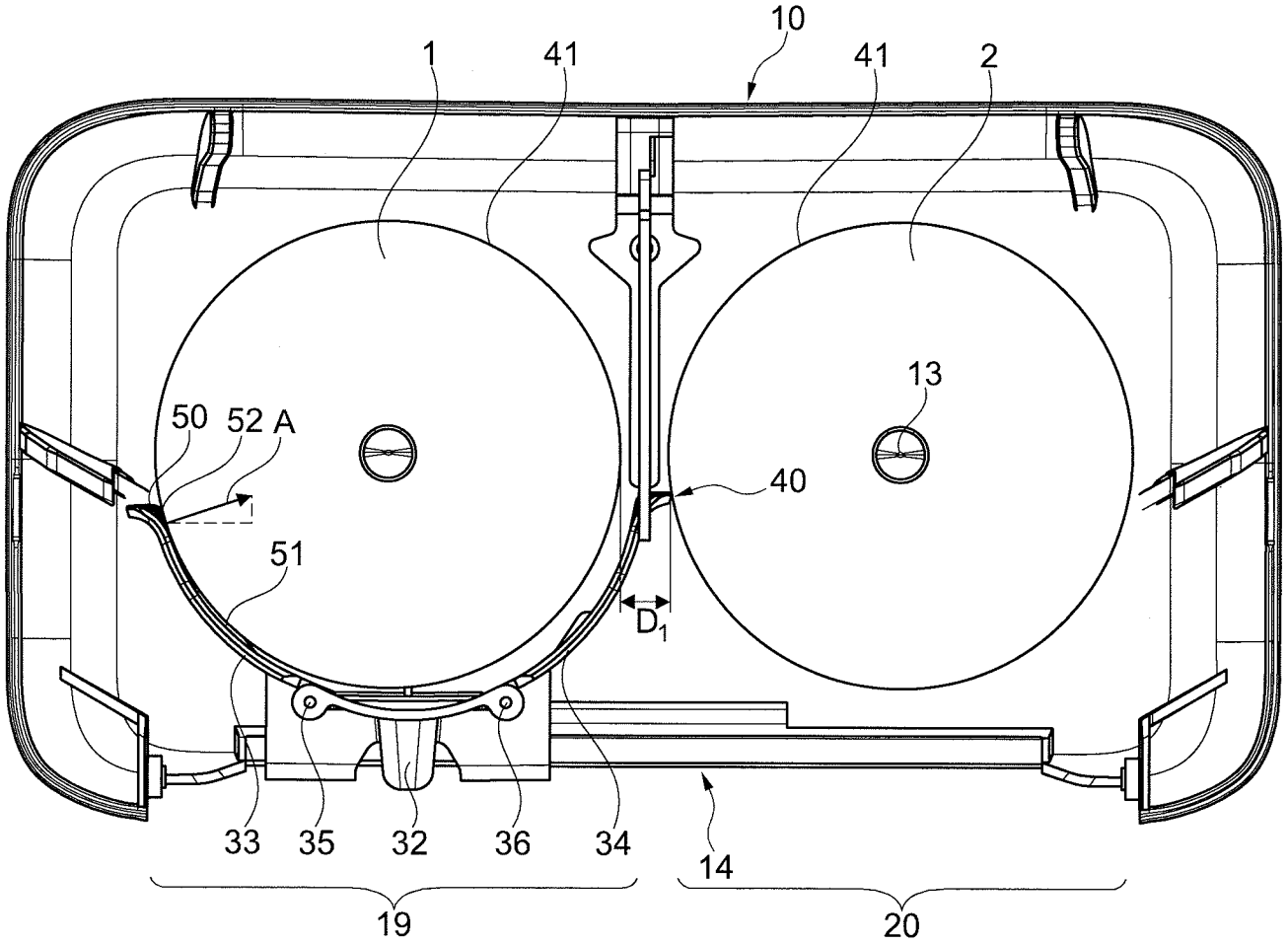
FIG. 3 shows a front view of the dispenser of FIG. 1 in which sliding of the closure is prevented by a completely non-dispensed roll.

If the user in this stage slides the closure 21 using the handle 32 toward the second position, that is in the drawings to the right, the second wall 34, particularly its second edge 40, interferes with (contacts, engages with) the outer circumferential surface 41 of the second roll 2 (see FIG. 3). In this position, the second wall 34 being in the blocking position, in which the stop 43 abuts at the back wall 23 of the body 22, cannot rotate about the axis 36 counterclockwise. Thus, the second wall 34 prevents the further movement of the closure 21 to the right. The distance of movement in this case corresponds to the distance D1.

At the same time, the spring 45 urging the first wall 33 toward the second wall 34 is tensioned, because the inner surface 51 of the concave portion 37 and the inner surface 52 of the bumps 50 engage with the outer circumferential surface 41 of the first roll 1, thereby rotating the first wall 33 about the axis 35 counterclockwise. If the user releases the closure 21, the spring 45 induces a force acting on the first wall 33 and via the first wall 33 on the outer circumferential surface 41 of the first roll 1. The forces thereby applied substantially parallel to the movement direction of the closure 21 to the right as indicated by the arrow A in FIG. 3. As a result, the closure 21 is automatically moved to the left into its originate position, the first position, as shown in FIG. 1.

Figure 4:
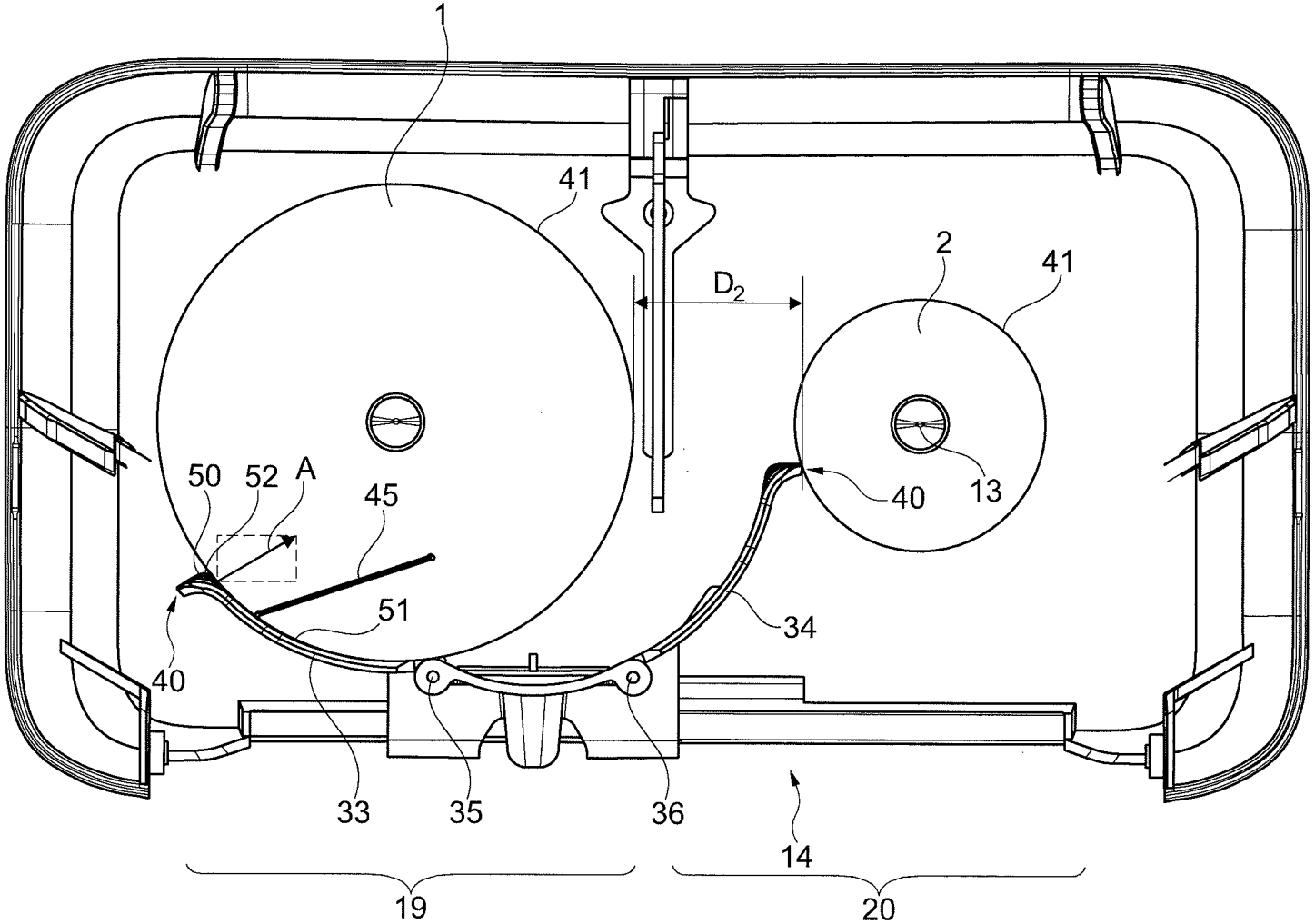
FIG. 4 shows a front view of the dispenser of FIG. 1 in which sliding of the closure is prevented by a partly non-dispensed roll.

If the second roll 2 is further dispensed and the diameter of the second roll 2 reduces as shown in FIG. 4, the amount of movement of the closure 21 to the right increases to a distance D2. However, still the edge 40 of the second wall 34 interferes with the outer circumferential surface 41 of the second roll 2, thereby preventing further movement of the closure 21 to the right.

In this stage, the first wall 33 is even further rotated about the axis 35, thereby increasing the tension of the spring 45. As can be seen from FIG. 4, which shows the spring, which is not visible in this view, by dotted lines, the spring acts substantially in parallel to a force vector perpendicular to the inner surface 52 of the bumps 50 and, thus, in an optimum direction to induce the force for returning the closure 21 into its originate position as shown in FIG. 1. Thus, the spring force required is not as high as if a spring was attached to the first edge 39 of the wall or if a torsion spring acted in the axis of rotation 35. In particular, because of the attachment of the spring 45 closer to the second edge 40 than to the first edge 39, the momentum achieved at the axis of rotation increases making use of a relatively large lever arm. In addition, the force vector is substantially parallel to the spring 45 meaning that not much force is lost acting in a different direction not usable for moving the closure 21 into its originate position. Moreover, because of the bumps 50, the inner surface acting on the outer circumferential surface 41 of the first roll 1 in this stage is moved further to the end of the wall 33, thereby also reducing the required force to return the closure 21 into its original position shown in FIG. 1.

Figure 5:
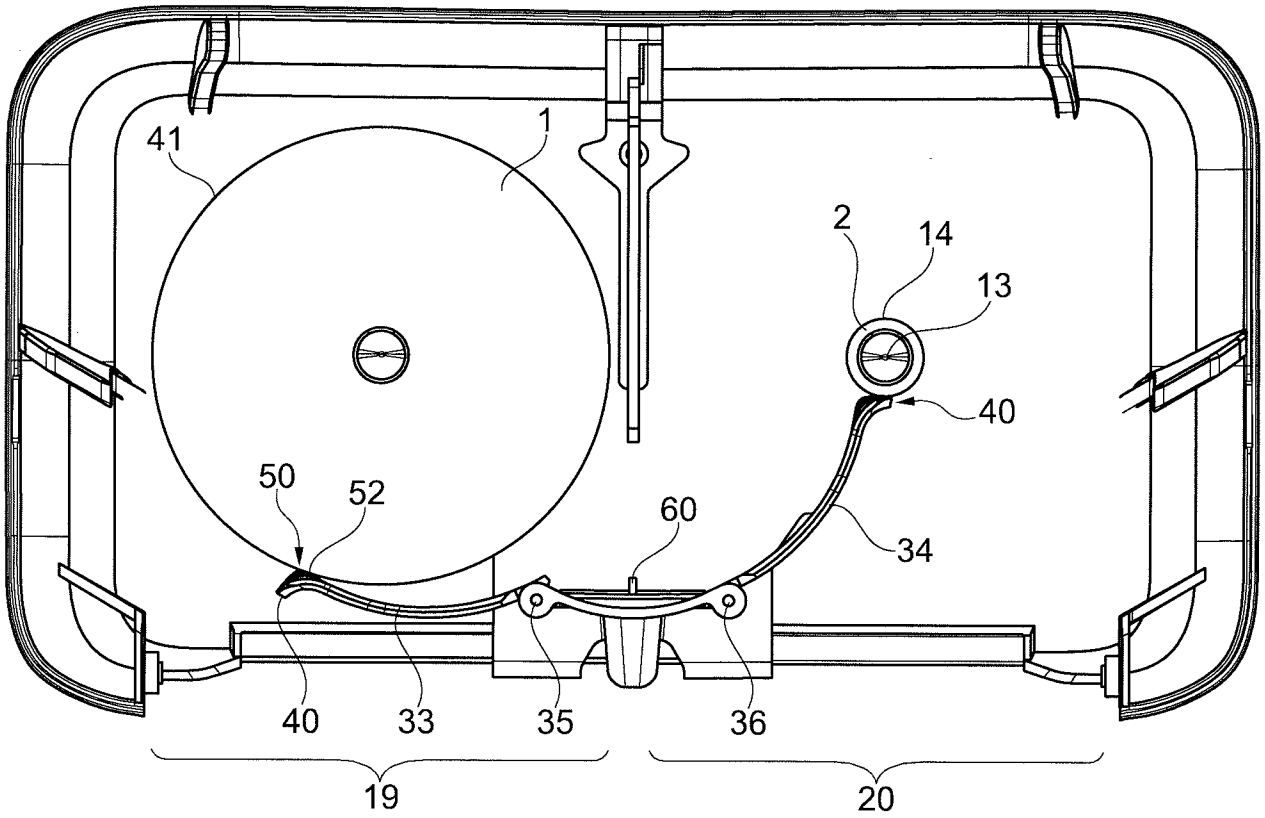
FIG. 5 shows a front view of the dispenser of FIG. 1 in which sliding of the closure is permitted because the roll is substantially dispensed.
Figure 6:
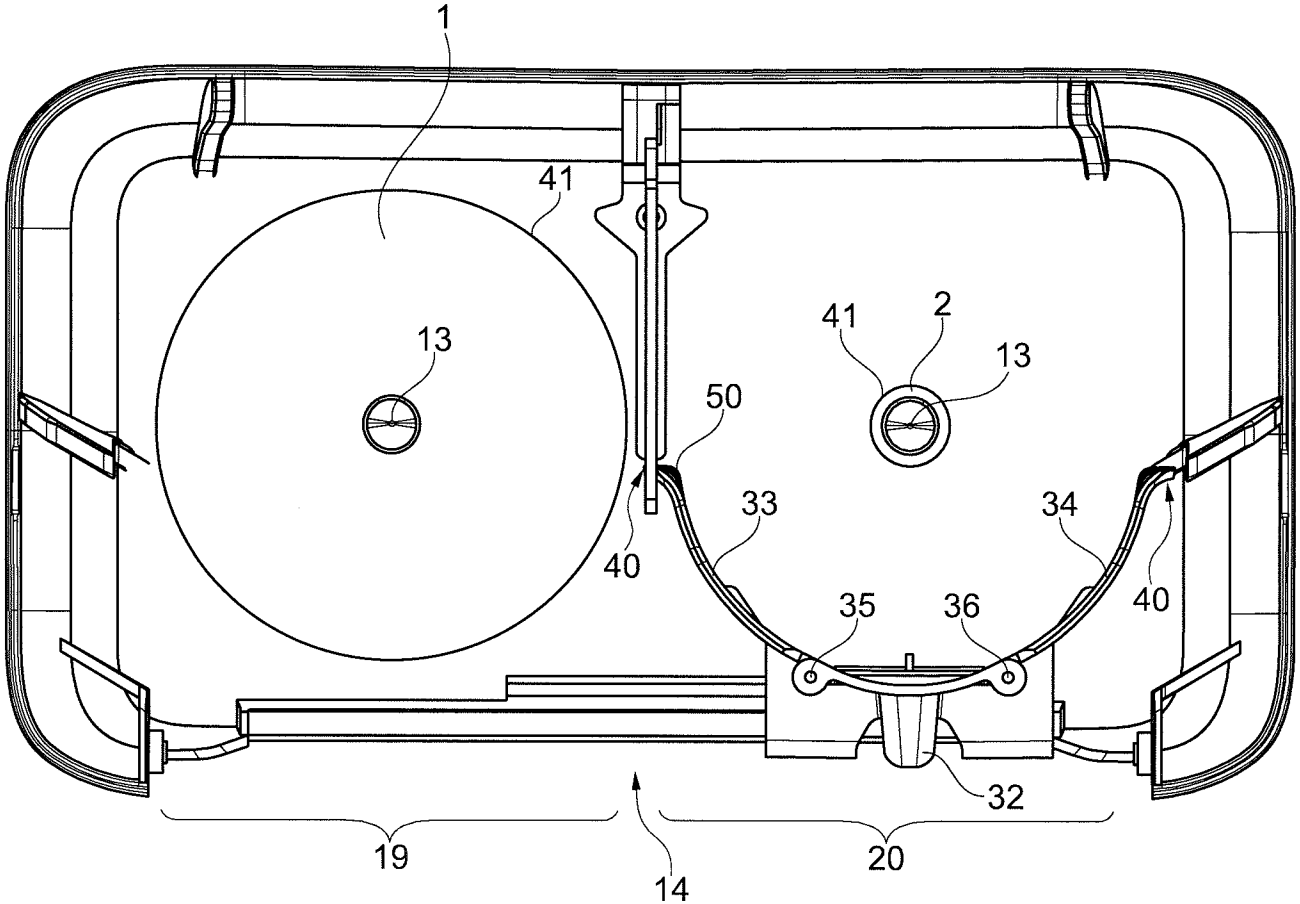
FIG. 6 shows a front view of the dispenser of FIG. 1 with the closure being slid to close the access opening in a portion corresponding to the substantially dispensed roll.

Finally, if the second roll 2 is substantially dispensed as shown in FIG. 5, the upper edge 40 of the second wall 34 may pass the second roll 2, whereby the first wall 33 is even further rotated counterclockwise about the axis 35, thereby allowing movement of the closure, particularly the second wall 33 past the first roll 1 so that the closure 21 may be moved completely into the second position as shown in FIG. 6. In the second position, the portion 20 of the access opening 14 is closed and access to the first roll 1 is given via the first portion 19 of the access opening 14. In this stage, a user can access the first roll 1 and dispense the paper by unreeling the first roll 1 and gripping the tail through the portion 19 of the access opening 14.

In this stage, the dispenser may be refilled by an operator removing the remaining portion of the second roll 2, if any, and replacing it by a new roll (then spare roll). If the first roll 1 is then again substantially dispensed, the closure 21 may be moved to the first position as shown in FIG. 1, whereby the process is the opposite to that shown in FIGS. 5 and 6. If the first roll 1 is not fully dispensed similar to the stage of the second roll 2 in FIG. 4 or the second roll 2 in FIG. 3, the closure 21 may not be moved to the left, because the upper edge 40 of the first wall 33 interferes with the outer circumferential surface 41 of the first roll 1. Similar as described above, the second wall 34 then serves to return the closure 21 into its originate position, then the second position covering the portion 20 of the access opening 14 as shown in FIG. 6.

In the above embodiment, a dispenser having two rolls has been described, but a dispenser having more than two rolls is as well conceivable, wherein the rolls are disposed in a row. Also the embodiment has been described together with the use of so-called coreless rolls, but the present disclosure may also be applied to common rolls having a core, for example made of cardboard. Even further, the walls have been described as being a concave/convex, but it was also conceivable to use straight or planar walls instead. Moreover, the present embodiment has been described using a substantially rectangular housing. However, it is also conceivable to use a housing which is more closely adapted to the outer circumferential surface 41 of completely new rolls. Thereby, the entire footprint of the dispenser on a wall can be reduced. In addition various other amendments are conceivable to the described embodiment and the invention is, therefore, only limited by the following claims.

The invention claimed is:

1. A dispenser for rolls of tissue paper, comprising:

a housing for accommodating at least two of said rolls;

an access opening defined in said housing for allowing access to the rolls; and a closure for selectively closing a portion of the access opening, the closure being slideably mounted to the housing between a first position closing a first portion of the access opening preventing access to a first roll of said rolls and a second position closing a second portion of the access opening preventing access to a second roll of said rolls, wherein the closure comprises:

a body;

a first wall having opposed first and second edges and being movably connected to the body at the first edge of the first wall;

a second wall having opposed first and second edges and being movably connected to the body at the first edge of the second wall;

a first spring urging the first wall toward the second wall; and a second spring urging the second wall toward the first wall, wherein the first and second wall are urged toward each other to respectively position the second edges of the first and second walls in a blocking position in which sliding of the closure into the second position is blocked until a predetermined amount of paper of the second roll has been dispensed and in which sliding of the closure into the first position is blocked until a predetermined amount of paper of the first roll has been dispensed, wherein spring force of the first and second springs is configured to automatically return the closure into the first position when sliding of the closure into the second position is blocked and to automatically return the closure into the second position when sliding of the closure into the first position is blocked.

2. The dispenser according to claim 1, wherein the first and second wall each comprises a bump adjacent to the second edge, the bump of the first wall protruding toward the second wall and the bump of the second wall protruding toward the first wall.

3. The dispenser according to claim 2, wherein the first and second walls have a concave portion from the first edges toward the second edges and a convex portion adjacent the second edges, respectively, wherein inner surfaces of the bumps facing each other are continuous with the concave portions, respectively.

4. The dispenser according to claim 1, wherein a first end of the first spring is connected to the first wall between the first and second edges of the first wall and a second end of the first spring is connected to the body, and wherein a first end of the second spring is connected to the second wall between the first and second edges of the second wall and a second end of the second spring is connected to the body.

5. Dispenser according to claim 4, wherein each wall comprises a support protrusion supporting the second ends of the first and second springs, the support protrusions protruding away from the first and second walls in a direction along an axis of rotation of the first and second walls, the support protrusions operating as a stop respectively limiting the rotational movement of the first and second walls toward each other.

6. The dispenser according to claim 4, wherein the first and second springs extend in the blocking position of the first and second walls along the sliding direction of the closure.

7. The dispenser according to claim 1, wherein the body comprises a gradually increasing rib extending along preferably the axis of rotation of the first and second walls.

8. The dispenser according to claim 7, wherein the rib connects at its highest position to a back wall of the body.

9. The dispenser according to claim 7, wherein the rib is located at a center between the axis of rotation of the first and second walls on the body.

* * * * *